US007510295B2

(12) United States Patent
Shih

(10) Patent No.: US 7,510,295 B2
(45) Date of Patent: Mar. 31, 2009

(54) MULTI-FUNCTION PENLIGHT STRUCTURE

(76) Inventor: Leo Shih, No. 3 Jingcheng 7th St., Taichung (TW)

( * ) Notice: Subject to any disclaimer, the term of this patent is extended or adjusted under 35 U.S.C. 154(b) by 67 days.

(21) Appl. No.: 11/699,896

(22) Filed: Jan. 29, 2007

(65) Prior Publication Data

US 2008/0180945 A1 Jul. 31, 2008

(51) Int. Cl.
*F21L 4/04* (2006.01)

(52) U.S. Cl. ..... 362/119; 362/198; 362/398

(58) Field of Classification Search ..... 362/119, 362/198, 202, 205, 398
See application file for complete search history.

(56) References Cited

U.S. PATENT DOCUMENTS 5,176,438 A * 1/1993 Fisherman ..... 362/99
D341,220 S * 11/1993 Eagan ..... D26/43
5,707,137 A * 1/1998 Hon ..... 362/183
5,716,121 A * 2/1998 Dubois ..... 362/198
7,052,155 B2 * 5/2006 Gavin et al. ..... 362/120
2003/0007346 A1 * 1/2003 Cooper et al. ..... 362/184
2004/0090776 A1 * 5/2004 Yang ..... 362/189
2005/0201085 A1 * 9/2005 Aikawa et al. ..... 362/198
2007/0223214 A1 * 9/2007 Yen ..... 362/118

* cited by examiner

*Primary Examiner*—Stephen F. Husar
*Assistant Examiner*—Peggy A. Neils
(74) *Attorney, Agent, or Firm*—Pro-Techtor Int'l Services

(57) ABSTRACT

A multi-function penlight structure comprises a body provided with a cell, a power button and an illuminative casing, in the outer front periphery of the illuminative casing being mounted a magnetic collar, and at the rear end of the body being formed a grip portion in which an extendable and retractable stem is received, and at the front end of the stem being attached a flexible member for connecting with the body, such that the penlight body can be extended, retracted and bent to any desired angle so as to attract a metal object by using the magnetic collar, and after retracting the stem and the flexible member back to the grip portion, the present invention can be simply used as a penlight, thereby achieving the multi-function purposes thereof.

5 Claims, 7 Drawing Sheets

MULTI-FUNCTION PENLIGHT STRUCTURE

BACKGROUND OF THE INVENTION

1. Field of the Invention

The present invention relates to a penlight structure, and more particularly to a multi-function penlight structure that can utilize its extendable, retractable and bendable functions to cause an illumination and an object attachment thereon in different conditions.

2. Description of the Prior Arts

Normally, the length of a prior art flashlight is limited within a certain range for portable or storable convenience, however, such a conventional flashlight can not be widely applied in some special conditions, e.g., while in a car maintenance, some related parts of the car are located in narrowly complicated positions, hence the flashlight is not permitted to directly illuminate at the desired positions, or while in the maintenances of large machines, the length of the conventional flashlight is too short to provide a long distance illumination, or as suffering some shades, the flashlight can not be extended into the illumination-required position and change its illuminative angle. As shown in FIG. 1, to solve such a problem, an improved illumination light 10 has been developed and includes a fastening seat 11 in which a cell (not shown) and a power switch are mounted for matingly retaining it onto a fixed object, one end of the fastening seat 11 provided with a flexible wire 12, another end of which is coupled to an illuminative casing 13. Although such an improved illumination light 10 can be utilized to change its illuminative angle for different requirements, it still has some defects as follows:

1. The flexible wire 12 is not easy to be retractable, hence its length can not be designed in a quite long length, thus resulting in a length limitation thereof such that a long-distance illumination are unable to be achieved.

2. Likewise, since the flexible wire 12 is not easily retractable, thus causing an inconvenient storage thereof.

3. Such an improved illumination light is only for use in some certain conditions but not for use as a flashlight, and a handle is not attached to it, besides, the flexible wire 12 is not easily retractable, thereby causing a portable inconvenience and a limited usage.

The present invention has arisen to mitigate and/or obviate the afore-described disadvantages.

SUMMARY OF THE INVENTION

The primary objective of the present invention is to provide a multi-function penlight structure comprises a body and a grip portion at the rear end of the body, in the grip portion being received an extendable and retractable stem, and at the front end of the stem being attached a flexible member for connecting with the body, such that the penlight body can be extendable, retractable and bendable to any desired angle for use in some special conditions.

Further objective of the present invention is to provide a multi-function penlight structure comprises the extendable and retractable stem received in the grip portion, and the flexible member attached at the front end of the stem for connecting with the body, the stem and the flexible member both are stored in the grip portion, thereby obtaining an easily storage and a portable convenience.

Another objective of the present invention is to provide a multi-function penlight structure further comprises a magnetic collar mounted in the outer front periphery of the illuminative casing, such that the penlight body can be extended, retracted and bent to any desired angle so as to attract a metal object by using the stem and the flexible member.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
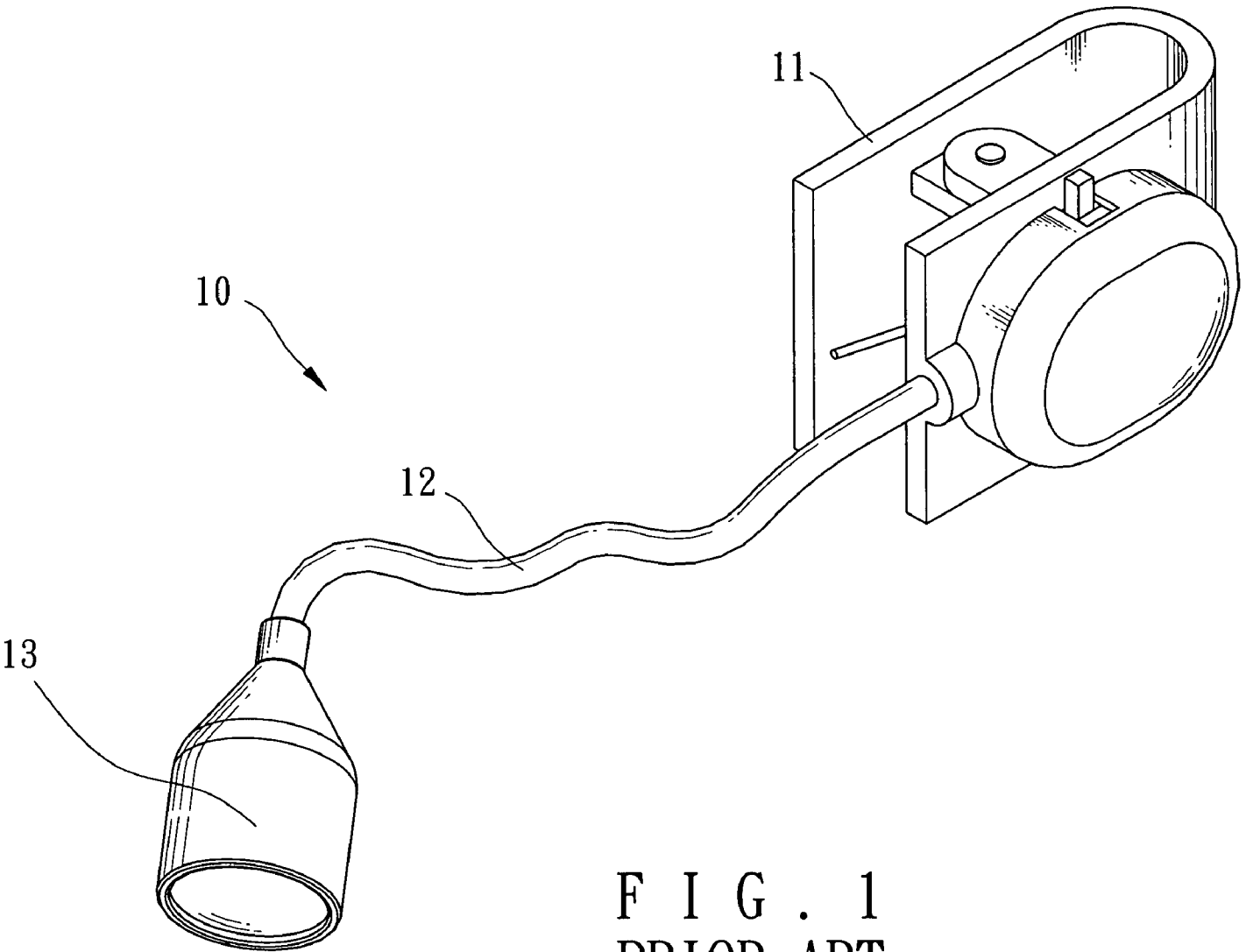
FIG. 1 PRIOR ART
FIG. 1 is a perspective view of a conventional improved illumination light.
Figure 2:
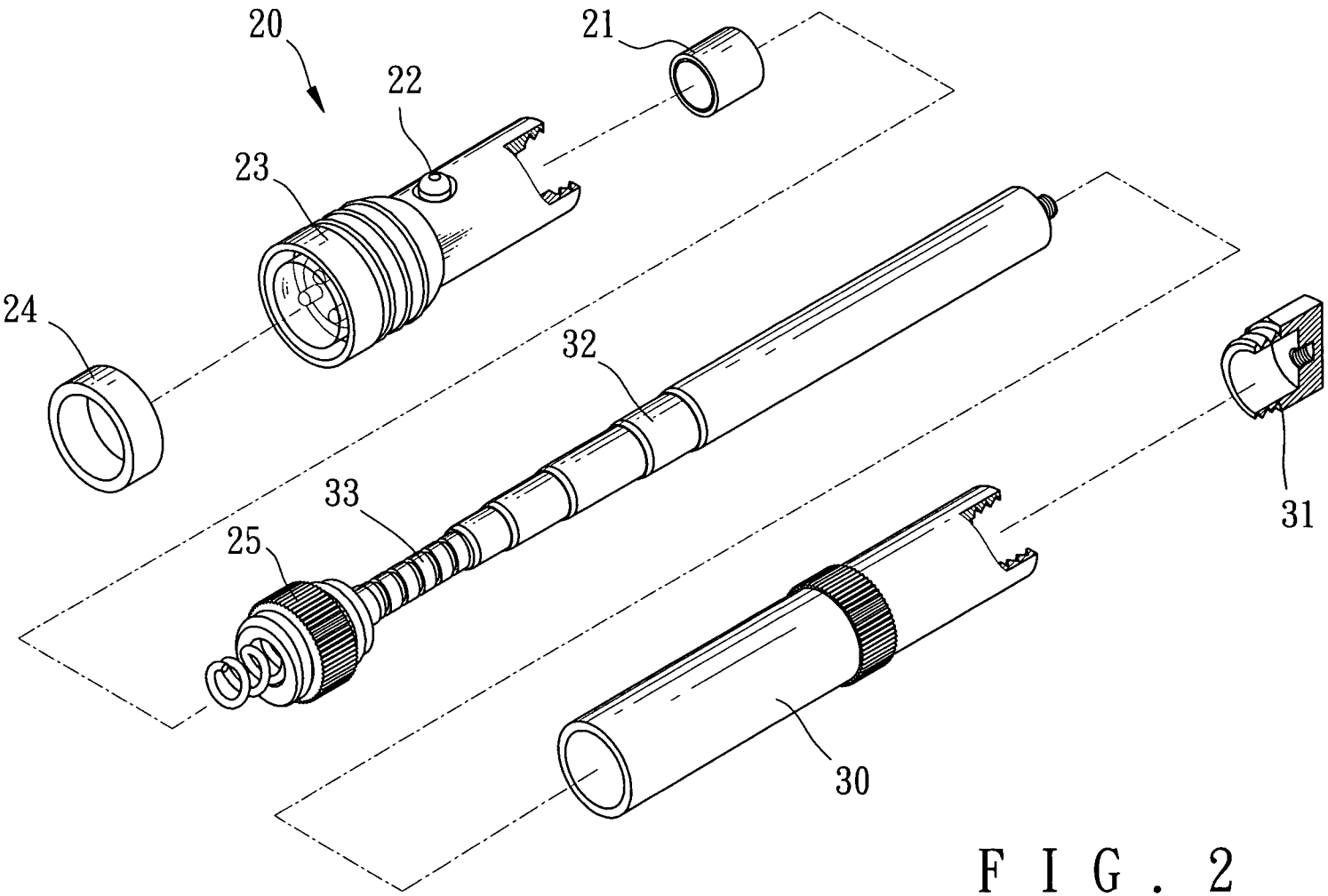
FIG. 2 is an exploded view of illustrating a multi-function penlight structure in accordance wit the present invention.
Figure 3:
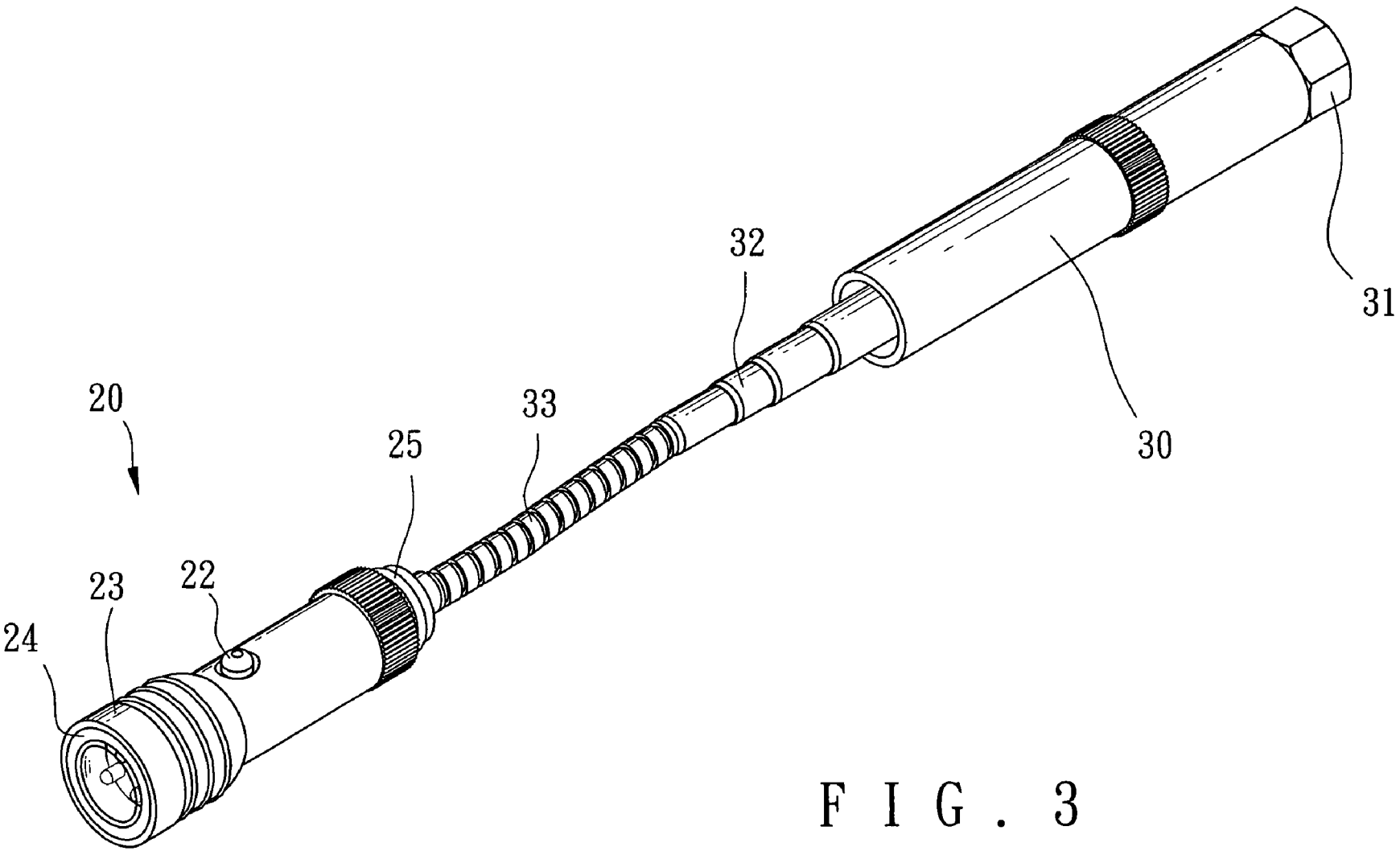
FIG. 3 is a perspective view of the multi-function penlight structure in accordance wit the present invention.

Referring to FIGS. 2-3, a multi-function penlight structure in accordance with the present invention comprises a illuminating body 20 and a grip portion 30, the illuminating body 20 including a cell 21 and a power button 22 therein and provided at the front end thereof with an illuminative casing 23, at the outer front periphery of the illuminative casing 23 being mounted a magnetic collar 24 for matingly attracting a metal object thereon, and at the rear end of the illuminating body 20 being secured a cover member 25 for retaining the cell 21 in the illuminating body 20. A hollow cylindrical grip portion 30 is defined at the rear end thereof with a fastening seat 31 in which an extendable and retractable stem 32 is retained and extended through the grip portion 30, and at the front end of the stem 32 is fixed a flexible member 33 which is stored in the stem 32 and connected to the cover member 25 such that the illuminating body can be extended, retracted and bent to any desired angle.

Figure 4:
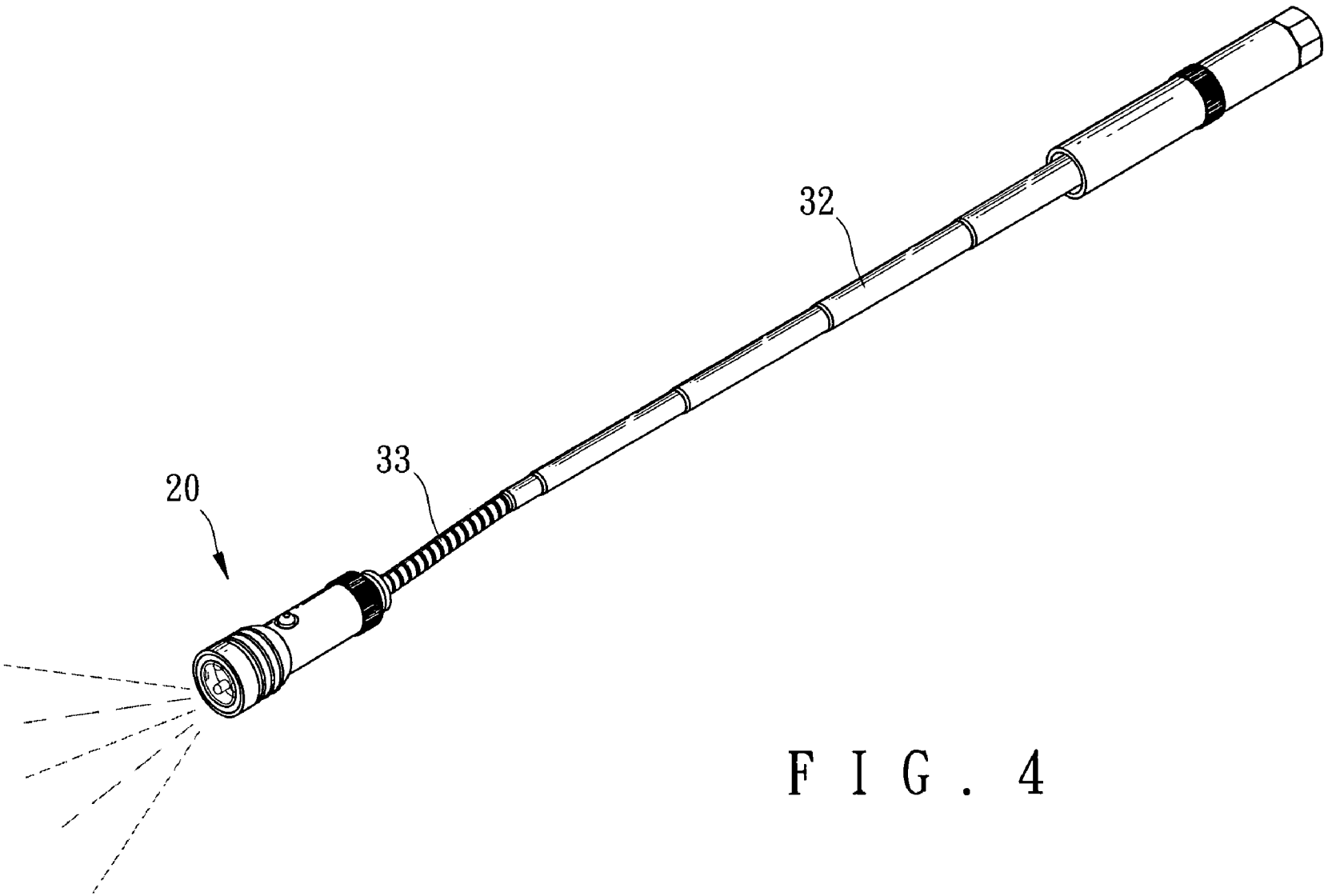
FIG. 4 is an operational view of illustrating the illuminative distance of the present invention being extended.

With reference to FIG. 4, while the present invention is in use for special conditions, the stem 32 is extended so as to pull the illuminating body 20 forwardly, such that the penlight can be formed in the shaped of an elongated rod, and since the illuminating body 20 is located at the front end of the stem 32, such a penlight is permitted to illuminate the object at a short distance.

Figure 5:
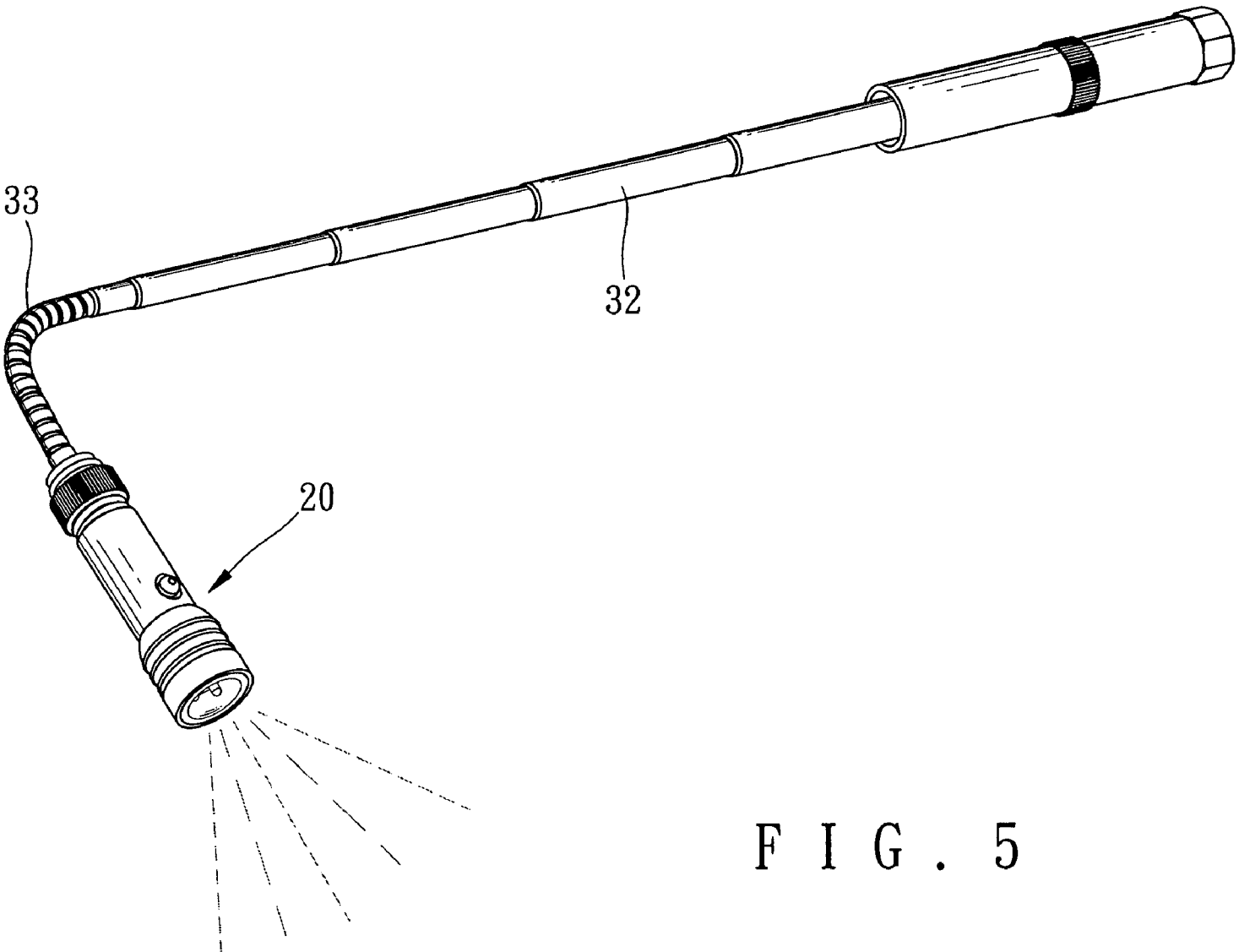
FIG. 5 is an operational view of illustrating the illuminative angle of the present invention being changed.

With reference to FIG. 5, in the operation of bending the flexible member 33 for use in a certain condition, the illuminating body 20 is bent to a desired angle so as to face toward the object and to avoid shades, thereby effectively illuminating the object.

Figure 6:
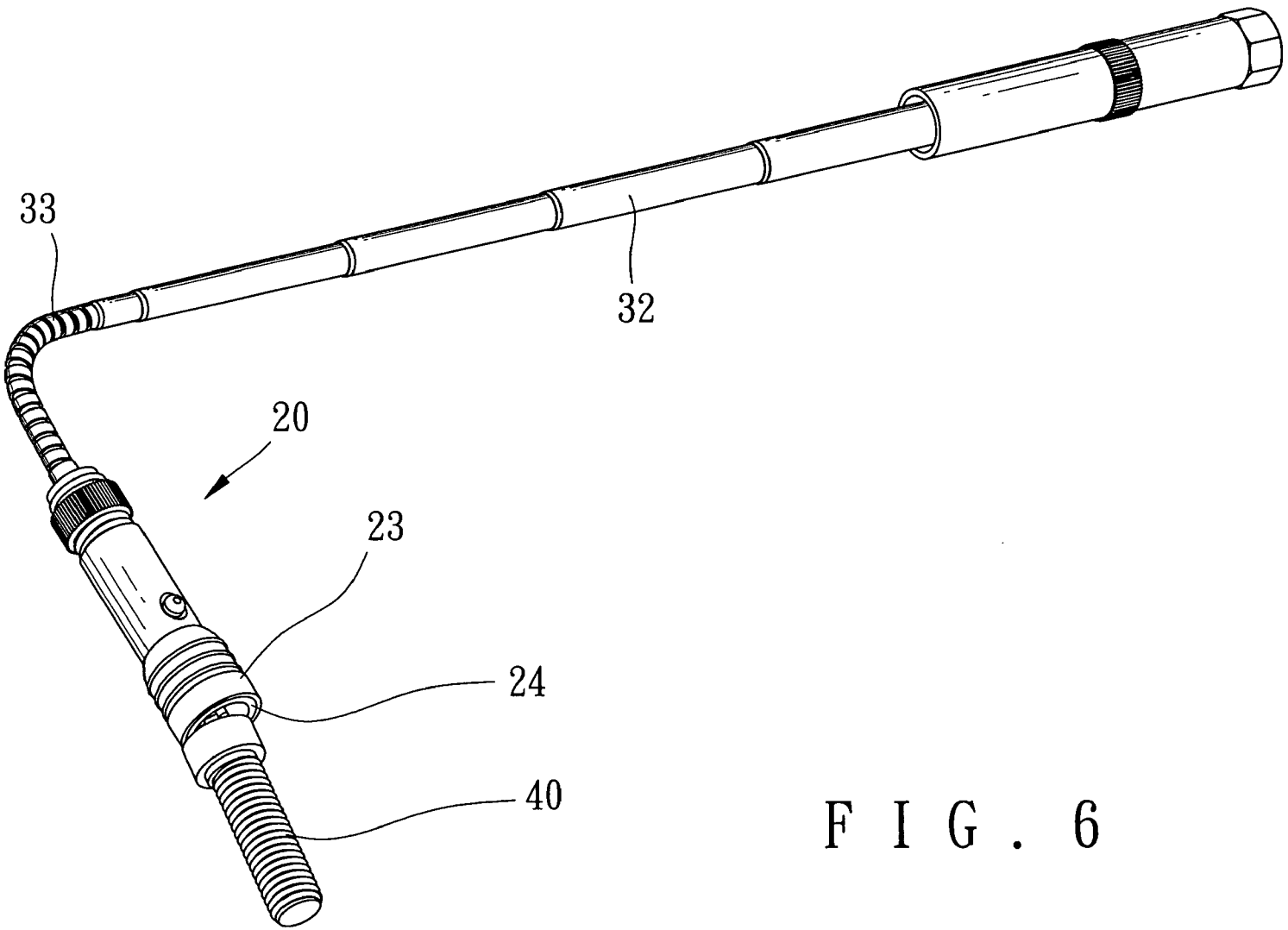
FIG. 6 is an operational view of illustrating the present invention being used to attract a metal object.

As shown in FIG. 6, due to the magnetic collar 24 is mounted in the outer front periphery of the illuminative casing 23, by way of the stem 32 and the flexible 33, the penlight is allowed to matingly attract the metal object 40 thereon at a long distance or a narrowly complicated space, thus achieving multi-function purpose such as illumination and object picking and the like purposes.

Figure 7:
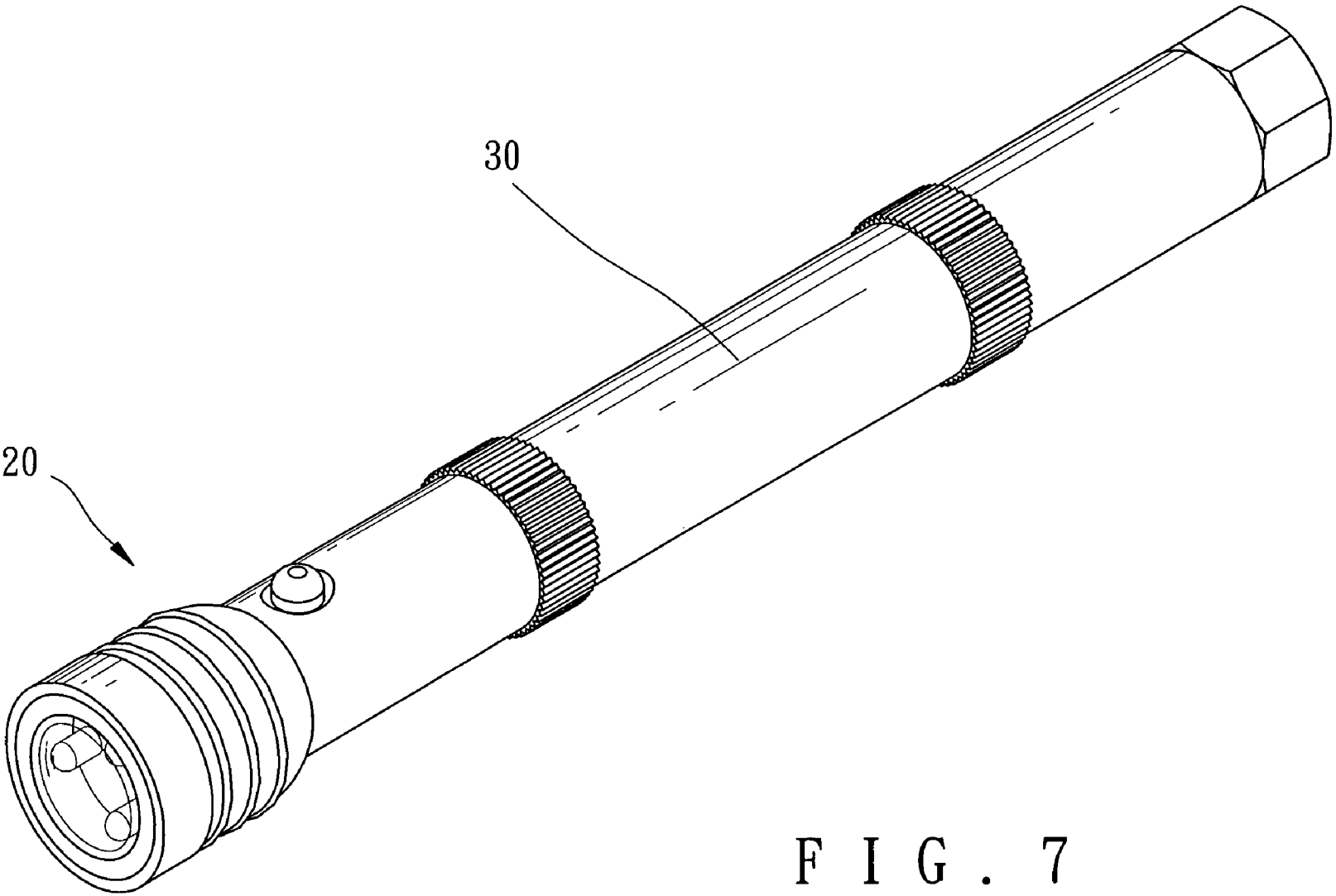
FIG. 7 illustrates the present invention being stored only for the use of the penlight.

As shown in FIGS. 3 and 7, since the stem 32 is storably received in the grip portion 30, and the flexible member 33 is received in the grip portion 30 as well, after retracting of the stem 32 and the flexible member 33 back to the grip portion 30, the body 20 is couplingly fitted to the end periphery of the grip portion 30, thus permitting use only for a penlight.

The invention is not limited to the above embodiment but various modifications thereof may be made. It will be understood by those skilled in the art that various changes in form and detail may made without departing from the scope and spirit of the present invention.

What is claimed is:

1. A multi-function penlight structure comprising:

a grip portion in the form of a hollow cylinder with a fastening seat defined at a rear portion thereof;

an extendable and retractable stem received interior of said grip portion, with a flexible member fixed to a front portion thereof; and an illuminating body connected to a front portion of said flexible member, including at least one cell, a power button, a cover member connecting a rear portion of said illuminating body to said stem and retaining said at least one cell, and an illuminative casing provided at a front portion of said illuminating body for providing illumination from the front portion of said illuminating body.

2. The multi-function penlight structure as claimed in claim 1, wherein a magnetic collar is mounted to said illuminative casing.

3. The multi-function penlight structure as claimed in claim 1, wherein said stem is retained at the rear end of said grip portion and extended therethrough.

4. The multi-function penlight structure as claimed in claim 1, said flexible member is stored in said stem.

5. The multi-function penlight structure as claimed in claim 1, wherein the front end of said flexible member of said grip portion is connected a cover member at the rear end of said body.

* * * * *